United States Patent [19]

Zinkin

[11] Patent Number: 4,685,670

[45] Date of Patent: Aug. 11, 1987

[54] ELASTIC TENSION EXERCISING APPARATUS WITH MULTIPLE PASS CABLE AND PULLEY

[76] Inventor: Harold Zinkin, 2377 W. Shaw, Suite 112, Fresno, Calif. 93711

[21] Appl. No.: 656,780

[22] Filed: Oct. 1, 1984

[51] Int. Cl.[4] ..... A63B 21/04

[52] U.S. Cl. ..... 272/136; 272/142; 272/DIG. 4; 272/900

[58] Field of Search ..... 272/93, 116, 117, 135-143, 272/900, 146, DIG. 4, 118

[56] References Cited

U.S. PATENT DOCUMENTS

| | | | |
|---|---|---|---|
| 254,142 | 2/1880 | de Bock . | |
| 511,251 | 12/1893 | Pickles | 272/142 |
| 679,784 | 8/1901 | Ryan | 272/900 X |
| 705,266 | 7/1902 | Mattsson | 272/136 X |
| 807,670 | 12/1905 | Grabner | 272/136 X |
| 931,699 | 8/1909 | Medart | 272/118 |
| 1,965,511 | 7/1934 | Preston | 272/136 |
| 3,162,442 | 12/1964 | Karlik . | |
| 3,438,627 | 4/1969 | La Lanne | 272/118 |
| 3,687,450 | 8/1972 | Schollmeyer | 272/137 |
| 3,840,227 | 10/1974 | Chesemore | 272/900 X |
| 4,328,965 | 5/1982 | Hatfield | 272/143 X |
| 4,466,613 | 8/1984 | Reese | 272/136 X |

FOREIGN PATENT DOCUMENTS

| | | |
|---|---|---|
| 627842 | 10/1927 | France . |
| 1086629 | 2/1955 | France . |

*Primary Examiner*—Richard J. Apley
*Assistant Examiner*—Robert W. Bahr
*Attorney, Agent, or Firm*—Nilsson, Robbins, Dalgarn, Berliner, Carson & Wurst

[57] ABSTRACT

An exercising apparatus using an elastic or spring type resistance provides a relatively constant controlled resistive force throughout an entire exercising stroke. In the exemplary embodiments, a multiple pass pulley arrangement attached to elastic rubber straps provides tension on a cable that is threaded through the multiple pulleys and extends at either end through openings in an elongated housing. An external hand grip is secured to one end of the cable to be grasped or otherwise engaged by the user and the other end can be adjustably secured in one of a series of detent stops along the length of the housing to set various resistive levels. The housing is secured at each end with an eccentrically placed swivel that facilitates free lateral movement in performing the exercise stroke.

11 Claims, 12 Drawing Figures

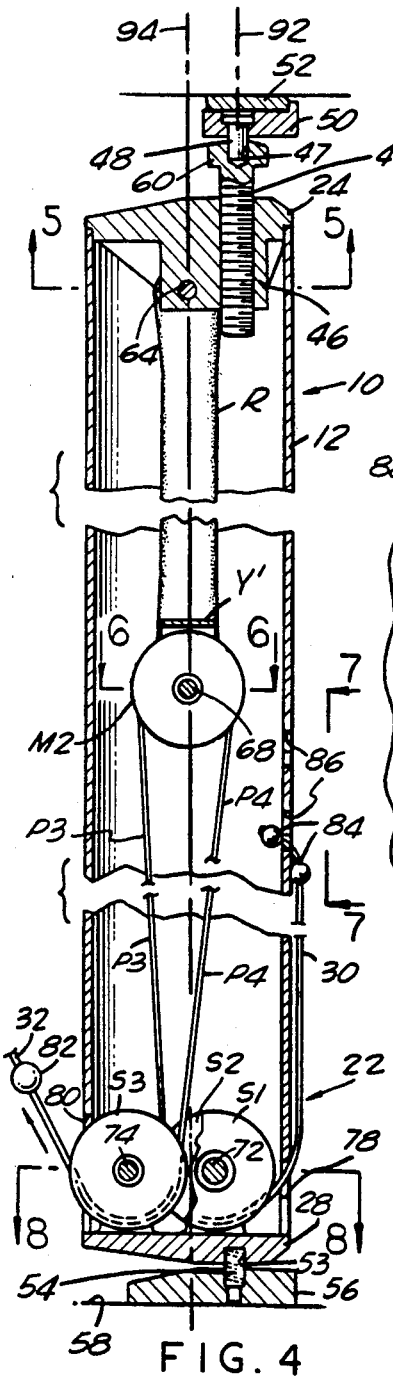
FIG. 4
FIG. 5
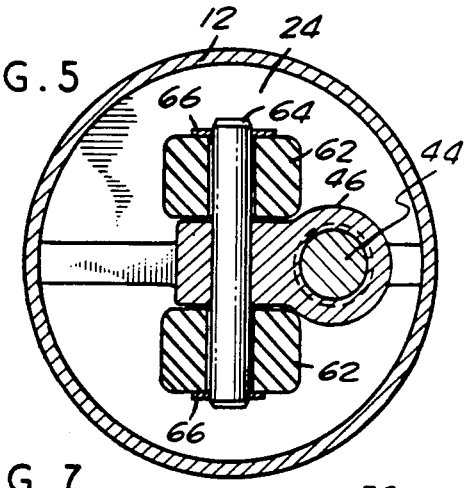
FIG. 7
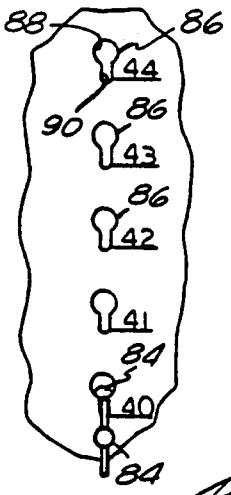
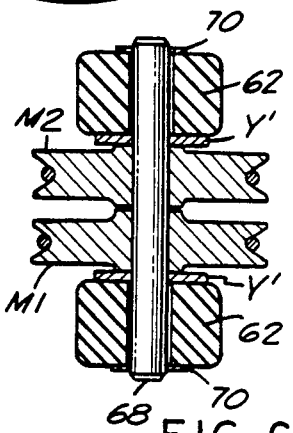
FIG. 6
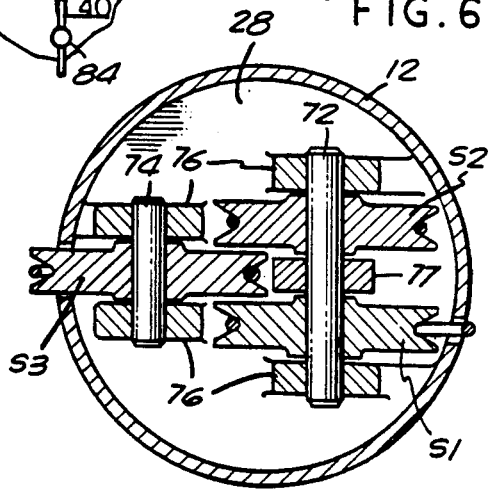
FIG. 8

ELASTIC TENSION EXERCISING APPARATUS WITH MULTIPLE PASS CABLE AND PULLEY

BACKGROUND OF THE INVENTION

The present invention relates to resistive exercising equipment and, more particularly, to an elastic tension exercising apparatus incorporating a multiple pass cable and pulley arrangement.

A variety of exercising devices have been proposed to build and maintain proper muscle conditioning. In most such devices, repetitive muscular exertions are performed against a controlled resistive force. Weight lifting is a common form of exercise against a controlled resistive force, and various machines have been developed for this purpose. More recently, sophisticated hydraulic and pneumatic systems have been developed. However, such machines are generally rather costly and occupy a substantial amount of space. They also tend to be specialized in purpose, requiring a large number of machines to exercise the different muscle groups of the body.

Low cost devices using springs or other elastic elements to supply a desired resistive force have also been proposed, and have enjoyed some degree of success. However, such devices have not been well accepted among serious exercisers because the level of resistance varies radically during a exercising stroke. This is caused by the proportional relationship between elongation and the resistive force produced by an elastic member. The force varies from zero at the beginning of an exercising stroke, when the element is unstretched, to undesirably high levels later in the stroke. Most modern exercise authorities agree that optimal physical results are achieved when a relatively constant resistive force is maintained throughout an exercising cycle.

Another problem with prior elastic systems is the difficulty of varying the resistive force to meet the requirements of a particular user or exercise. A user will typically benefit from an increase in resistive force after performing an exercise regularly for several days. However, the level of resistive force encountered with most prior devices can be increased only by adding or replacing elastic elements. This is particularly troublesome when the device is used in a gym or health club by people of different strength capabilities, or for exercising muscle groups of varying strength.

Therefore, it is desirable in many applications to provide a compact and inexpensive device for providing an adjustable resistive force which remains substantially constant throughout an exercising stroke.

SUMMARY OF THE INVENTION

The present invention has at least one resistance element having a first portion held stationary relative to a base and a second movable yoke portion movable against an elastic resistive force. At least two primary semblant pulleys are carried with the movable yoke portion and at least one secondary semblant pulley is mounted to the base at a location spaced from the primary pulleys. A flexible force transmitting member, such as a cable, is threaded between the primary and secondary pulleys to engage in sequence one of the primary pulleys, one of the secondary pulleys, and then the other primary pulley. The force transmitting member has one end held stationary relative to the base with its other end actuable in tension by a user during an exercise to draw the primary pulleys toward the secondary pulleys and thereby stress the resistance element against the elastic force.

In a preferred embodiment, the second end of the force transmitting member is actuable from a rest condition to a subsequent extended condition, and retracts toward the rest condition upon release, but retraction is limited so that the force transmitting member is tensioned by the resistance element in a "start" position to provide a preselected range of resistive force during an exercise. The preferred embodiment may further include means for adjusting the tension on the force transmitting member, and thus the range of resistive force during an exercise, by adjusting the effective length of the force transmitting member in the rest condition.

In another preferred embodiment, the movable yoke portion is connected to the resistive element at a first preselected location and the primary pulleys are supported by the yoke portion for rotation about an axis spaced from that location in the direction of the secondary pulleys.

The structure of the present invention provides a compact, inexpensive and versatile resistive exercising system that can be mounted in a doorway for use in performing a variety of exercises at different force levels. In the multiple pass system of the invention, a cable or other force transmitting member is threaded alternately between a pair of movable pulleys and at least one stationary pulley to reduce displacement of the movable pulleys relative to the distance through which the cable is pulled. The movable pulleys are coupled to elastic resistance elements to apply tensile forces to the cable within a desired narrow range, and in a manner which tends to stablize the pulleys.

Although pulleys have been used in prior cable-operated resistive exercising devices, they have typically been used simply to change the direction of a tensile force and not to minimize the variation of force during an exercising stroke. In addition, such arrangements have not embodied the structure of this invention, in which at least two movable pulleys are used to produce multiple cable paths which maintain the resistive force within a preselected narrow range. Each additional cable path reduces the change in deformation of the elastic member by increasing the number of paths over which the cable pull distance is distributed. Since the resistive force of an elastic member is proportional to deformation, the force varies over a narrower range than would otherwise be the case. In a four-path system having two movable pulleys and three stationary pulleys, the elastic elements are stretched through a distance only one-quarter as great as the distance through which the cable end is pulled. This reduces the range of resistive force to one-quarter what it would otherwise be.

Two prior devices having a pulley carried by one end of an elastic member are disclosed in Karlik, U.S. Pat. No. 3,162,442 and Casteyre, French patent No. 627,842. However, it is believed that the movable cables disclosed therein are used primarily to change the direction of force on a cable, and not to minimize deformation of a resistance element. In any event, neither reference shows a pair of movable pulleys coupled for movement together with the end of an elastic resistance element, as in the present invention.

The level of resistive force produced by the device of the present invention is also easily adjustable by altering the effective length of the cable or other force transmitting member. The manually actuated end of the cable is provided with a stop for preventing retraction of the cable beyond a certain point, and the opposite end of the cable is adjustably secured in one of a plurality of detent stops along the length of the housing to adjust the position in which it is held stationary. Each position of engagement of the cable in one of the detent stops corresponds to a different effective length of cable within the device in the "start" position, and thus a different condition of pretension. After the pretension is set, the opposite end of the cable is actuable against a resistive force within a corresponding narrow range.

In a preferred embodiment, the device of the present invention is contained in an elongated vertical housing mounted for eccentric swiveling movement in a doorway or other suitable location. The manually actuated end of the cable then exits the housing at a location furthest from the axis of swiveling movement, causing the device to be self-aligning in accordance with the direction in which the cable is pulled.

BRIEF DESCRIPTION OF THE DRAWINGS

The above and other features of the present invention may be more fully understood from the following detailed description, taken together with the accompanying drawings, wherein similar reference characters refer to similar elements throughout, and in which:

FIG. 4 is a vertical sectional view taken along the line 4—4 of FIG. 3;

FIG. 5 is a horizontal sectional view taken along the line 5—5 of FIG. 4;

FIG. 6 is a horizontal sectional view taken along the line 6—6 of FIG. 4;

FIG. 7 is a fragmentary rear elevational view of a portion of the apparatus housing, taken in the direction 7—7 of FIG. 4;

FIG. 8 is a horizontal sectional view taken along the line 8—8 of FIG. 4;

DESCRIPTION OF THE PREFERRED EMBODIMENT

Figure 1:
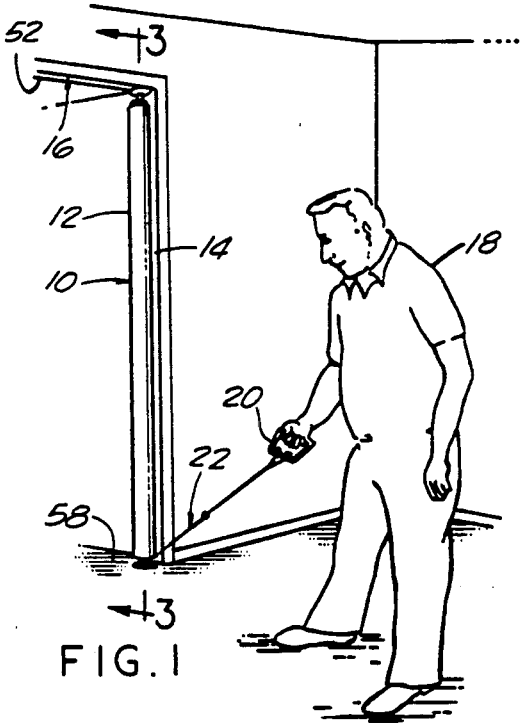
FIG. 1 is a perspective view showing one exemplary embodiment of an exercising apparatus constructed in accordance with the invention, wherein the apparatus is mounted in a doorway and is being used by an exerciser.

Referring now to the drawings, specifically FIG. 1, one form of exercising apparatus 10 constructed according to the present invention has a housing 12 mounted vertically near a jamb 14 of a doorway 16. The apparatus can be used in any one of a variety of exercising routines by an individual 18 pulling outwardly on a handle 20 connected to a cable 22.

Figure 2:
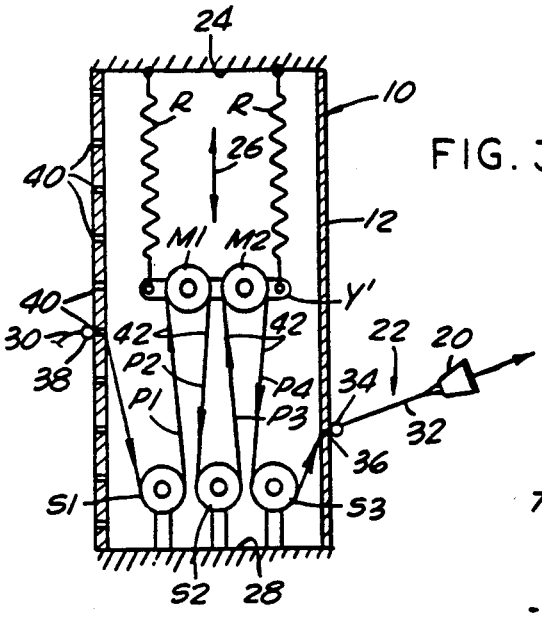
FIG. 2 is a schematic depiction of the basic components of the apparatus of FIG. 1, illustrating the operating principle thereof.

The basic operating principle of the apparatus 10 is illustrated schematically in FIG. 2, wherein a cable or other flexible force transmitting member 22 is threaded alternately back and forth between a pair of movable semblant pulley means (M1 and M2) and three stationary semblant pulleys (S1, S2 and S3). The movable pulleys are mounted for rotation on a yoke Y which is attached to the lower ends of a pair of elastic resistive elements R. The upper ends of the resistive elements are fixed to an upper base structure 24 of the housing 12, permitting reciprocal movement of the yoke Y in a direction 26 to elastically deform the resistance elements. The stationary pulleys (S1, S2 and S3) are mounted to a lower base structure 28 of the housing for rotation within a plane parallel to the movable pulleys (M1 and M2).

A first or "inner" end 30 of the cable 22 is anchored to the housing 12 at a location on one side of the stationary pulleys, while a second or "far" end 32 of the cable extends outwardly through the opposite side of the housing. The end 32 is restrained from being drawn inwardly beyond the illustrated "start" position by an enlarged element 34, such as a clamp or knot in the cable, which engages a restricted opening 36 of the housing. The inner end 30 of the cable has a similar enlarged element 38 engageable with different restricted openings or "detent stops" 40 of the housing to adjust the effective length of the cable and thereby pretension the cable in the start position. A user pulling outwardly on the handle 20 initially encounters a preselected resistive force equal to the level of pretension on the cable. As the cable is drawn outwardly, the yoke Y moves downwardly through a distance equal to only one-quarter the distance moved by the "far" end 32 of the cable. Thus, during an exercising stroke the extension of the resistance elements is changed by only one-quarter the distance of cable movement at its "far" end, causing the range of resistive force encountered during an exercising stroke to be reduced accordingly. That range is defined by the adjustment of the inner cable end 30 relative to the restrictive slots 40 of the housing.

It will be understood that the term "semblant pulleys", as used herein, refers to any suitable structure for changing the direction of a tensile member, including simple pulley wheels, chain-type sprocket wheels, or even curved stationary surfaces for guiding a flexible force transmitting member through a preselected path. Similarly, the cable 22 may be any suitable flexible force transmitting member including, without limitation, a rope, cord, chain, wire, or cable.

As seen in FIG. 2, the flexible force transmitting member 22 engages the various semblant pulleys in the order S1, M1, S2, M2, and S3, tracing from the "inner" end 30 to the "far" end 32. This provides four paths 42 between the movable and the stationary pulleys, giving a four-to-one reduction in linear displacement. However, the pulleys S1 and/or S3 can be eliminated, if desired, without departing from the basic concept of the present invention. With both pulleys S1 and S3 eliminated, the cable engages the pulleys M1, S2, and M2, in sequence, to provide at least two pulley paths producing a two-to-one displacement ratio.

It is also significant that the pulley yoke Y is attached to the lower ends of the resistance elements R at opposite sides of the two movable pulleys. This tends to stabilize the apparatus during operation, preventing any temporary fluctuations in tension between the various cable paths from disrupting the smooth operation of the device.

Referring now to the embodiment illustrated in the FIGS. 3–8, the upper and the lower base structures 24 and 28 are preferably formed as end caps closing opposite ends of the cylindrical housing 12. The upper base 24 has a support shaft 44 that extends vertically through it to be threadably engaged in a boss 46 formed on the underside of the base structure 24. The shaft 44 has an axial recess 47 (FIG. 4) for reception of a pivot pin 48 extending downward from an upper friction plate 50 that engages an overhead frame 52 of the doorway 16. The lower base 28 is formed with a similar axial recess 53 for reception of a pivot pin 54 extending up from a lower friction plate 56 that engages a sill 58 of the doorway 16 as illustrated. Final adjustment of the apparatus within the doorway is achieved by rotating the support shaft 44 relative to the boss 46 of the upper support structure. A hexagonal head 60 is provided at the upper end of the support shaft for this purpose.

In the preferred form, the resistance elements R constitute elongated rubber straps or other elastic materials having enlarged end portions 62. However, the resistance elements may be any suitable "elastic" material that exerts a predetermined resistance to stretching or other linear deformation and has sufficient memory to fully recover after deformation that does not exceed its elastic limit. Thus, it may be a rubber or rubber-like material, a metallic spring deformed within its elastic range, or any other suitable e1ement having the desired characteristics. The characteristic most importance to the practice of the invention is the ability of the element to exert a reactive, elastic force which varies substantially proportionately with the extent of deformation. Such elements are typically simple, reliable and inexpensive.

The upper ends of the resistance elements R are connected at opposite sides of the boss 46 of the upper base structure by a pin 64 extending through the boss. The mounting portions are retained on the pin by snap rings or other suitable elements 66. The lower end portions 62 are attached to a modified yoke Y′ by a shaft 68 passing through the end portions and the yoke. The lower end portions may similarly be retained on the shaft 68 by suitable snap rings 70.

The pulleys of the embodiment illustrated in FIGS. 3–8 are conventional pulley wheels, and the force transmitting member may be a cord or cable. The pulley wheels are arranged somewhat differently than in FIG. 2 for compactness, the movable pulleys M1 and M2 being positioned side-by-side within the modified yoke Y′, and the stationary pulleys S1, S2 and S3 being arranged in a triangular pattern, as shown in FIG. 8. In the triangular arrangement, the wheels S1 and S2 are disposed side-by-side, with the third wheel S3 positioned ahead of the first two wheels and fitting partially between them. Aside from producing a more compact structure, the triangular arrangement helps keep the cable on the pulleys during use. Thus, the stationary pulleys are mounted for rotation on respective shafts 72 and 74, each of which is carried by a pair of opposed ears 76 extending upwardly from the lower base structure 28. In this configuration, the ears supporting the pulley wheel S3 fit closely over the edges of the pulleys S1 and S2 to keep the cable 22 in place thereon, and a washer 77 between the first two stationary pulleys fits closely over the edge of the pulley S3 to keep the cable in place. Thus, any temporary slack condition in the cable, such as by disengagement of the cable at one end or rapid release of the cable from an extended condition, does not result in the cable becoming tangled or disengaged from the stationary pulleys. Similarly, the cable is maintained in engagement with the respective movable pulleys M1 and M2 by the yoke Y′. In this embodiment, the yoke Y′ is a simple U-shaped member where the closed end covers the peripheral grooves on the pulleys.

Figure 3:
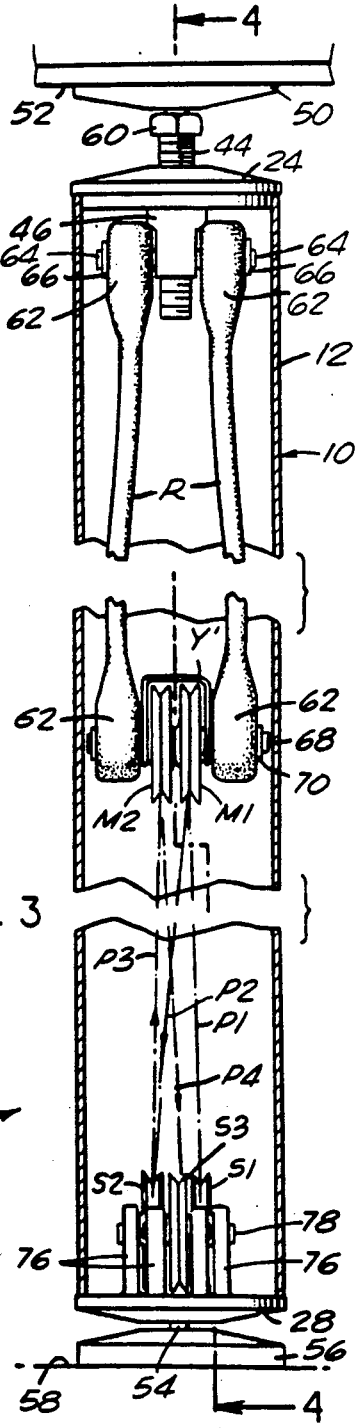
FIG. 3 is a partial vertical sectional view taken in the direction of 3—3 of FIG. 1.

The internal path of the cable 22, as shown in FIGS. 3, 4 and 8, begins where it enters the housing 12 through an opening 78 near the inner end of the cable, and it exits through a slot 80 near its outer end. From the opening 78, the cable 22 engage the stationary and movable pulleys in the sequence described in connection with FIG. 2. In particular, the cable passes inwardly from the opening 78 beneath the stationary pulley S1 to the forward edge of the movable pulley M1 to form the path segment P1, as shown in FIG. 3. The cable then passes over the pulley M1 down its rear edge along the path segment P2 to engage the stationary pulley S2 before passing to the movable pulley M2 along a path segment P3 which extends from the front of the pulley S2 to the front of the pulley M2. The cable then passes over the pulley M2 and down its rear edge to the rear of the pulley S3 along a path segment P4. It then goes beneath the pulley S3 and out of the housing through the slot 80 to engage a handle 20 to be grasped by the user. An enlarged element 82 is provided on the cable 22 near its outer end to engage the slot 80 and prevent retraction of the cable by the resistance elements beyond its initial "start" position. Thus, the pulley and cable arrangement of the preferred embodiment (FIGS. 3–8) has four cable paths (P1-P4) which are functionally equivalent to the four paths 42 of FIG. 2.

As discussed above, the level of pretension on the cable 22 in its "start" condition is determined by the effective length of the cable and the extent of deformation of the resistance elements R in that condition. The effective length of the cable can be adjusted in the embodiment of FIGS. 3–8 by selectively engaging one or more enlarged elements 84 of the inner end of the cable with a plurality of adjustment openings or detent "stops" 86 of the housing. Each adjustment opening has an enlarged portion 88 and a restricted slot portion 90 for reception and retention of the elements 84 in a manner illustrated in FIGS. 4 and 7. Each of the openings 86 may be marked to indicate the force at which the cable is pretensioned when the inner end of the cable is engaged there, allowing an operator to quantify and reproduce a particular tension adjustment according to his personal needs.

In accordance with the present invention, the housing 12 preferably is held in an eccentric swivel mount as illustrated in FIGS. 3 and 4, for free rotation about a vertical axis 92 that is displaced from its central axis 94 in a direction away from the outlet slot 80. To accomplish this, the support shaft 44 of the upper base structure and the pivotal recess 53 of the lower base structure are offset slightly from the central axis 94. Because the cable 22 is pulled from the outlet slot 80 during use, the force applied by the user generates a torque that rotates the housing to align it with the cable segment extending from the handle. Therefore, the housing 12 is automatically realigned to constantly maintain the desired orientation, accommodating lateral movements during the course of an exercise. This insures that the cable rides smoothly on the outlet pulley S3, minimizing the chance of entanglement or undue wear of the cable.

Also, the housing 12 may be inverted to perform exercises by pulling the cable from either a high or a low point. Either of the two pivot pins 48 or 54 of the friction plates 50 and 56 can be spring loaded to allow the device to be inverted without the use of tools. In FIG. 4, the lower pivot pin 54 is illustrated as spring loaded in an axial direction for this purpose.

In operation, an exerciser installs the apparatus 10 within a doorway by pivotally engaging the friction plates 50 and 56 with the two base structures and placing the apparatus in the position shown. The support shaft 44 is then rotatably adjusted to force the base structures 24 and 28 into frictional engagement with the overhead frame 52 and the sill 58 of a doorway. The level of cable tension is adjusted by grasping the inner end 30 of the cable, releasing the enlarged elements 84 from one of the restricted slots 90 and securing the enlarged elements within a slot corresponding to the desired tensile force. The apparatus is then ready for use by pulling the handle 20 and the cable 22 outwardly and/or upwardly relative to the housing 12 against a resistive force which begins at the level of the preset tension and does not vary beyond a preselected narrow range. During the exercise, the housing 10 can swivel about an eccentric axis to align with the direction of cable tension, thus eliminating problems of cable wear or entanglement. If the user desires to change the resistive force to perform a different exercise, he simply releases the handle 20 and moves the cable end 30 to a different one of the slots 90 where markings on the housing 12 enable the user to accurately select the proper tension level. If it is desired to perform an exercise in a downward direction, the entire apparatus can be inverted within the doorway so that the outlet slot 80 and the handle 20 are located near the top of the doorway.

Figure 9:
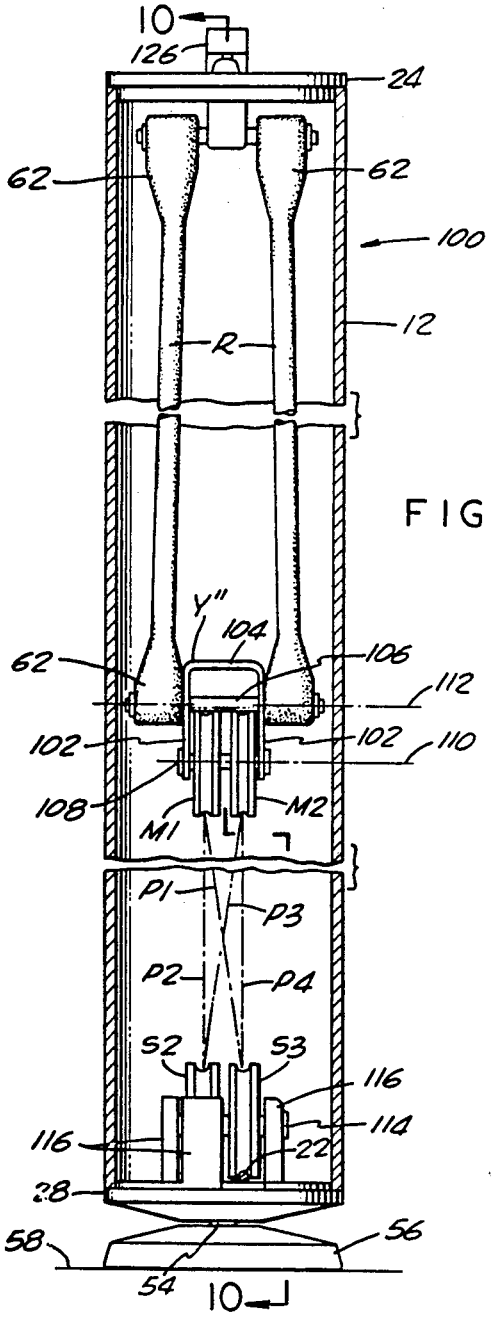
FIG. 9 is a partial vertical sectional view of another exemplary embodiment of an exercising apparatus constructed in accordance with the invention, taken in a direction corresponding generally to the direction 3—3 of FIG. 1.
Figure 10:
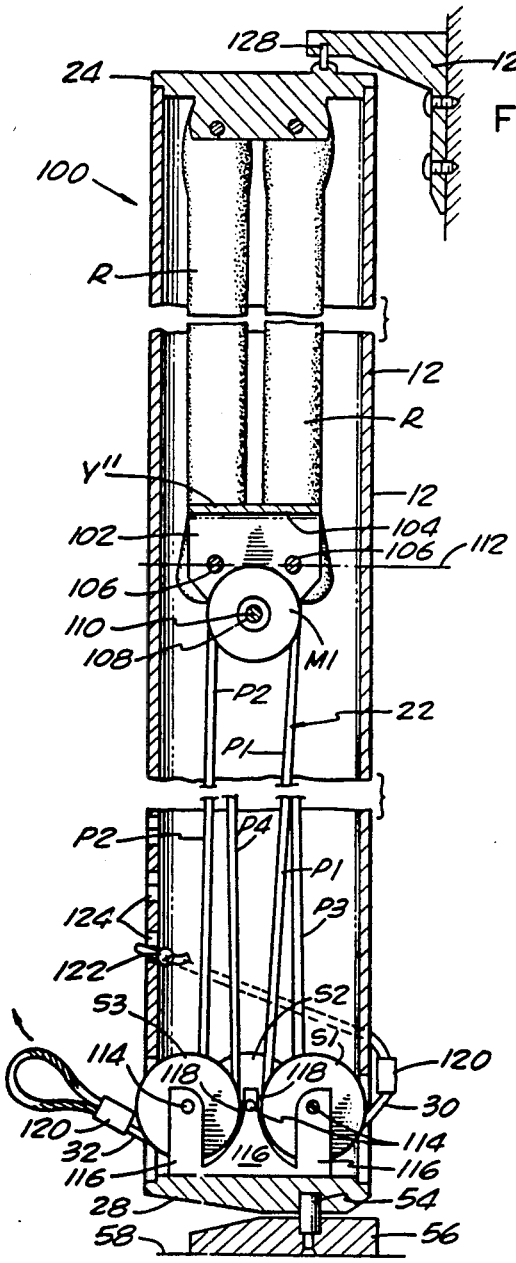
FIG. 10 is a vertical sectional view taken along the line 10—10 of FIG. 9.

Another form of exercising apparatus 100, which is preferred in cases of heavier use, is illustrated in FIGS. 9 and 10. The apparatus 100 is similar in many respects to the apparatus 10 of FIGS. 3–8, and to that extent is provided with similar reference numerals. Accordingly, the discussion of the apparatus 10 is applicable generally to the apparatus 100 and only the differences between the apparatuses will be discussed in detail herein.

Referring now to FIGS. 9 and 10, the apparatus 100 has a yoke Y″ which is mounted for movement with the lower ends of four resistance elements R. The yoke Y″ is a U-shaped member having a pair of depending parallel arms 102 and an upper transverse portion 104. The yoke is joined to the resistance elements by a pair of pins 106 extending transversely through the parallel arms 102 and the lower end portions of respective pairs of the resistance elements. Pulley wheels M1 and M2 are mounted for rotation between the parallel arms about an axle pin 108 below the pins 106. Thus, the movable pulleys are mounted for rotation about an axis 110 which is parallel to the plane 112 of the pins 106 and spaced from the plane in the direction of the stationary pulleys S1, S2 and S3. As shown in FIG. 10, the movable pulleys are located close to the pins 106, so that the pins prevent the cable from jumping off the pulleys.

The embodiment 100 is preferred when stabilization of the yoke is particularly important. Four resistance elements (R) provide increased capacity and support the yoke at four spaced locations. The pins 106 straddle the axis 110, each pin engaging a pair of the resistance elements at opposite sides of the yoke. In addition, the structure of the embodiment 100 facilitates assembly of the parts because the movable pulley wheels M1 and M2 can be mounted to the yoke either before or after the yoke is connected to the resistance elements.

Figure 11A:
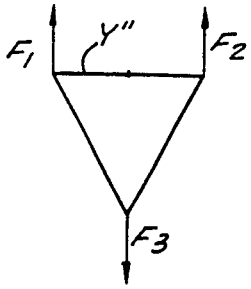
FIG. 11A is a somewhat diagrammatic representation of a triangular arrangement of forces analogous to the forces on the movable yoke of the apparatus illustrated in FIGS. 9 and 10.
Figure 11B:
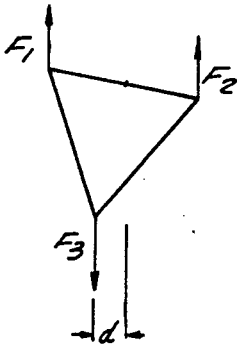
FIG. 11B is a somewhat diagrammatic representation of the arrangement of FIG. 11A in a unbalanced force condition.

Centering of the pulleys M1 and M2 below the plane of connection to the resistance elements "triangulates" the forces on the yoke, thereby enhancing stability about an axis perpendicular to the plane of FIG. 9. The concept of triangulation, as used herein, is illustrated conceptually in FIGS. 11A and 11B. $F_1$ and $F_2$ are upward forces applied by the elements R at opposite sides of the yoke Y″, and $F_3$ is a generalized downward force applied by the cable. FIG. 11A depicts a condition of balanced upward forces ($F_1=F_2$) and FIG. 11B depicts a condition of unbalanced upward forces ($F_1>F_2$). In FIG. 11B, the greater force ($F_1$) tends to rotate the yoke clockwise, causing the point of application of the force $F_3$ to move laterally by a distance "d". This produces a corrective moment of magnitude "$F_3d$" in the counterclockwise direction. The corrective moment is not present when the force $F_3$ is applied midway between $F_1$ and $F_2$ because the point of application does not move in that case. Although this analysis is approximate, in that it does not take into account the lateral spacing of the downward forces applied through the pulleys M1 and M2, it is applicable in concept to the present case.

The placement of stationary pulleys (S1 through S3) in the apparatus 100 is similar in function to that of the apparatus 10, but provides a different arrangement of pulley paths (P1 through P4). The pulleys S1 and S3 are located along a common plane and the pulley S2 is parallel to them. The pulleys S1 through S3 are mounted for rotation on parallel pins 114 which are supported by a series of upwardly projecting ears 116 of the lower base structure 28. One of the ears supporting the wheel S2 is positioned between the wheels S1 and S3, and has oppositely curved edge profiles 118 which fit closely over the edges of the wheels to hold the cable in place. Similar profiles are provided on the ears located behind wheels S1 and S3, as viewed in FIG. 10. As a result, the cable 22 remains properly threaded over the stationary pulley wheels S1 through S3, even if the tension on the cable is momentarily released.

The inner end 30 and the outer end 32 of the cable 22 are each provided with a loop formed by a clamping collar 120. The collar at the outer end 32 prevents retraction of the cable end into the device, and the associated loop permits attachment of a handle (not shown) for pulling the cable during an exercise. The loop at the inner end 30 extends around the housing 12, where it can be held in a plurality of different positions by selective engagement of a detent ball 122 carried by the loop with a series of stop openings 124 in the wall of the housing. Each stop opening corresponds to a different condition of extension of the cable end 30 relative to the housing, providing a different amount of pretension in the manner described in connection with the device 10.

The operation of the device 100 is similar to that described above in connection with the device 10, except that the mechanism of the device 100 has greater stability and the amount of pretension is adjustable by movement of a loop rather than a free end of the cable. The cable passes through the pulleys in the order described in connection with the apparatus 10, providing the same four-to-one ratio between displacement of the handle and extension of the resistance elements. The housing is eccentrically mounted in similar fashion, although one or both ends of the housing may be supported by a vertical surface rather than horizontal one. This is accomplished with mounting brackets of the type illustrated at 126 (FIG. 10). The housing pivots relative to the bracket about an eccentric pin 128, which may be spring-loaded for ease of device removal or inversion.

From the above, it can be seen that the present invention provides an inexpensive yet versatile resistance-type apparatus for performing a wide range of exercises at preselected narrow ranges of resistance.

While certain specific embodiments of the invention have been disclosed as typical, the invention is of course not limited to those particular forms, but rather is applicable broadly to all such variations as fall within the scope of the appended claims. As an example, resistance elements R may be replaced by a single resistance element or by three or more such elements, depending upon the circumstances of use. Similarly, the physical configuration of the device may vary from the strictly vertical configuration of the preferred embodiment, and the housing can be made of any suitable rigid materials.

I claim:

1. An exercise apparatus comprising:

base means;

resistance means having a fixed portion held stationary relative to the base means and a movable portion capable of being displaced from said fixed portion against an elastic reactive force;

at least two primary semblant pulley means carried with the movable portion of the resistance means;

at least one secondary semblant pulley means mounted to the fixed portion of the resistance means at a location spaced from the primary pulley means;

a flexible force transmitting member threaded between the primary and secondary pulley means to engage one of the primary pulley means, one of the secondary pulley means and another of the primary pulley means, in sequence;

the force transmitting member having a first end held stationary relative to the base means and a second end actuable in tension by a user during an exercise to draw the primary pulley means toward the secondary pulley means and thereby stress the resistance means against said elastic force, said second end of the force transmitting member being actuable from a start condition to a subsequent extended condition and retracting toward the start condition upon release;

means for limiting said retraction so that the force transmitting member is tensioned by the resistance means in the start condition to provide a preselected range of resistive force during an exercise; and means for adjusting the tension of the force transmitting member in the start condition, and thus the range of resistive force during an exercise, by adjusting the effective length of the force transmitting member, said tension adjusting means comprises means for adjusting said efective length at the first end of the force transmitting member.

2. The apparatus of claim 1 wherein:

the tension adjusting means comprises detent means attached at the first end of the force transmitting member and releasably engageable with the base means in any of a plurality of different positions along said base means corresponding to different effective lengths of the force transmitting member.

3. The apparatus of claim 2 wherein:

said movable portion of said resistance means includes yoke means supporting said primary pulley means for rotation thereon and for movement therewith.

4. The apparauts of claim 3 wherein:

the yoke means is connected to the movable portion of the resistance means at a first preselected location; and the primary pulley means are supported by the yoke means for rotation about an axis spaced from said first preselected location in the direction of the secondary pulley means.

5. The apparatus of claim 3 wherein:

the resistance means comprises at least two elastic elements connected to said yoke means on opposite sides of said primary pulley means.

6. The apparatus of claim 3 wherein:

the resistance means comprises at least four elastic elements connected to said yoke means on opposite sides of said primary pulley means.

7. The apparatus of claim 1 wherein:

the primary and secondary pulley means comprise a plurality of pulley wheels disposed for rotation in substantially parallel planes.

8. The apparatus of claim 7 wherein:

the secondary pulley means further comprises an additional pulley wheel engaging the force transmitting member at a location between said primary pulley means and said second end.

9. The apparatus of claim 8 wherein:

the secondary pulley means further comprises another pulley wheel engaging the force transmitting member at a location between the primary pulley means and said first end.

10. An exercise apparatus comprising:

base means including an elongated housing which extends between opposite end portions and along a longitudinal axis;

resistance means having a fixed portion held stationary relative to the base means and a movable portion capable of being displaced from said fixed portion against an elastic reactive force;

at least two primary semblant pulley means carried with the movable portion of the resistance means;

at least one secondary semblant pulley means mounted to the fixed portion of the resistance means at a location spaced from the primary pulley means; and a flexible force transmitting member threaded between the primary and secondary pulley means to engage one of the primary pulley means, one of the secondary pulley means and another of the primary pulley means, in sequence;

the force transmitting member having a first end held stationary relative to the base means and a second end actuable in tension by a user during an exercise to draw the primary pulley means toward the secondary pulley means thereby stressing the resistance means against said elastic force, and said housing having an outlet opening through which the second end of the flexible force transmitting member passes; and means for mounting the housing at said opposite end portions for pivotal movement about a preselected offset axis displaced from the center of the housing in a direction away from the outlet opening.

11. The apparatus of claim 10 wherein:

the outlet opening is located adjacent to one of said end portions; and the means for mounting the housing are releasable to permit inversion of the housing within the mounting means.

* * * * *